US005412845A

United States Patent [19]

Ueding et al.

[11] Patent Number: 5,412,845

[45] Date of Patent: May 9, 1995

[54] PROCESS AND DEVICE FOR THE JIGGING OF A FLAT CAN

[75] Inventors: Michael Ueding, Ingolstadt; Michael Strobel, Eichstätt; Albert Kriegler, Rottenegg; Jürgen Sauer, Ingolstadt, all of Germany

[73] Assignee: Rieter Ingolstadt Spinnereimaschinenbau AG, Ingolstadt, Germany

[21] Appl. No.: 128,609

[22] Filed: Sep. 29, 1993

[51] Int. Cl.[6] ..... D01G 27/00

[52] U.S. Cl. ..... 19/159 R

[58] Field of Search ..... 19/159 R, 160; 112/278

[56] References Cited

U.S. PATENT DOCUMENTS

| | | | |
|---|---|---|---|
| 1,858,945 | 5/1932 | Thierfelder | 19/160 X |
| 2,546,557 | 3/1951 | Naegeli | 19/159 R |
| 2,986,781 | 6/1961 | Jackson et al. | 19/160 |
| 3,081,511 | 3/1963 | Sluggs et al. | 19/159 R X |
| 3,339,244 | 9/1967 | Van Deusen | 19/159 R CR |
| 5,027,730 | 7/1991 | Dobner | 112/278 |
| 5,237,726 | 8/1993 | Gartenmann et al. | 19/159 R |

FOREIGN PATENT DOCUMENTS

| | | | |
|---|---|---|---|
| 0459956A1 | 12/1991 | European Pat. Off. . | |
| 1158420 | 11/1963 | Germany . | |
| 1923621 | 1/1973 | Germany . | |
| 2918995 | 11/1980 | Germany . | |
| 1054964 | 1/1967 | United Kingdom | 19/159 R |
| 09711765 | 11/1982 | U.S.S.R. | 19/159 R |
| 1219514 | 7/1986 | U.S.S.R. | 19/159 R |

*Primary Examiner*—Clifford D. Crowder
*Assistant Examiner*—Ismael Izaguirre
*Attorney, Agent, or Firm*—Dority & Manning

[57] ABSTRACT

The invention is a process and a device for the jigging of a flat can in a textile draw frame. According to the invention, the flat can is subjected to different dynamic moments in the translational movement along the jigging path. It is a characteristic of the invention that the speed is regularly modified in proximity of the reversal points (P1, P2), i.e. in the area of the reversal paths (UW1, UW2). The jigging device is provided with a driving device which renders the constant translational movement changeable in proximity of the reversal point (P1, P2). The driving device may be a servomotor controlled by a computer which serves as the control device. In another embodiment the diving device is a different, less expensive electric motor on the drive shaft of which belt pulleys capable of being coupled are installed.

22 Claims, 3 Drawing Sheets

PROCESS AND DEVICE FOR THE JIGGING OF A FLAT CAN

BACKGROUND OF THE INVENTION

The present invention relates to a process and to a device for the jigging of a flat can in a textile draw frame. The jigging influences the depositing of the fiber sliver. If errors occur in the depositing of the fiber sliver, this has harmful repercussions on the withdrawal of the fiber sliver. The time it takes to fill a can is determined by the possible delivery speed of the fiber sliver and the jigging speed of the flat can which is correlated to it. The quality of the fiber sliver depositing is thus also determined by the manner in which jigging takes place.

The form of a flat can is essentially different from that of a round can. The flat can has a rectangular area, with the long sides being delimited by narrow forward sides. The flat can is equipped with a can tray capable of being moved vertically. The can tray is positioned below the upper can rim when empty.

According to the state of the art, the flat can is filled by moving the flat can back and forth, i.e. by jigging it, while the delivery device (rotary plate) remains stationary.

The fiber sliver is deposited cycloidically over the length of the movable can tray. Several such layers of deposited fibers constitute a fiber column.

During the translation of the flat can, its speed is synchronized with the speed of the delivery device. The back-and-forth movements of the flat can take place at a constant speed up to the point of reversal. Until now it was common practice to move the flat can with a constant speed value as it is being jigged, i.e. the flat can strikes the limit stop constituting the reversal point at a constant speed. The limit stop is here of such dimensions that it absorbs the dynamic energy of the flat can. For this reason it was important to achieve an extremely rapid reversal of direction, as much as possible without any delay, in order to move the flat can immediately with a corresponding speed value in the opposite direction.

The sudden reversal of the movement has as a consequence that the fiber sliver column in the flat can is very much shaken and sways. Abrupt speed or acceleration changes occur at the reversal point. This expresses itself in violent impacts on the flat can. Such periodic impacts disturb the depositing of the fiber sliver and eventually the build-up of the fiber sliver column. The fiber sliver is pushed out of the desired depositing path at the forward sides of a flat can by these impacts. Such disturbances increase the danger of sliver breakage as the sliver is withdrawn.

The translation movement furthermore results in heavy swaying of the fiber sliver column at the reversal points, and this also interferes with the depositing of the sliver loops at the forward sides of the can. Swaying briefly creates gaps between sliver column and side. The sliver loop may be knocked into this gap during reversal and may become wedged. This interferes with the depositing of the fiber sliver and the build-up of the sliver column.

For these reasons it was not possible to increase the delivery speed of the fiber sliver significantly when filling a flat can.

Neither is this possible with the solution according to DE-AS 1158420 and DE-AS 1923621, since they already have the above-mentioned shortcomings. The solution according to DE-AS 19 23 621 therefore merely intends to create an improved process for the depositing of fiber slivers in rectangular cans. As DE-AS 19 23 621 (column 3, lines 48–54) explains, increased filling of a rectangular can is achieved thanks to the cycloidically deposited windings and the paths of the windings lying next to each other in a special zigzag or meandering fashion, while the initially mentioned disadvantages are not eliminated. DE-AS 1158420 has the special feature that a depositing container (cardboard box) is installed on the conveyor rollers of a platform during the filling process, with the conveyor rollers having no function in the jigging of the depositing container.

DE-AS 291895 proposes to stop a container on a plate during filling, the plate being displaced by means of a coordinate-controlling control device. The coordinate-controlling device is merely able to control the XY coordinates of the plate in accordance with two mechanical control curves. One single speed is set and maintained for the filling process.

EP457 099 recognizes that relatively large masses of fiber sliver are moved during the back-and-forth movement of a flat can as it is being filled. In the known process the speed of the translation movement of the flat can is increased briefly before reaching the reversal point and is returned to a predetermined translation speed after reaching that point (column 4, lines 56–58, column 4, lines 1–4). It has not been possible to prevent the depositing of the sliver loop from being disturbed at the front.

The process solutions according to the state of the art are thus not suited to achieve undisturbed depositing over the entire height of the can near the front of the flat can. Neither was it possible in this connection to increase the depositing speed. Because of these shortcomings, it was not possible to achieve the depositing speed of the fiber sliver which can already be achieved with round cans.

The device for the filling of a flat can is equipped with a travelling carriage arrangement to support the flat can according to DE-AS 19 23 621. The carriage arrangement consists of an upper and a lower carriage which are moved automatically under the influence of a programming device and of control devices. The can is placed on the upper carriage. A rotary plate is stationary above the can and delivers the fiber sliver. The can is held by the lower can sides on the upper carriage. This has the disadvantage that an undesirable force moment is exerted upon the can sides and the can tray of the can as the fiber sliver column sways as a result of the can movement.

The basic disadvantage of such filling devices is however the fact that a relatively large mass must be moved back and forth. This mass is not only constituted by the flat can, but especially also by the supporting platforms or the carriage structure. Drive and drive elements are thus subjected to great stress.

The device according to EP 457 099 avoids this disadvantage in that the cans are suspended from a conveying device. The conveying device is equipped for that purpose with detachable holding elements from which the flat can is suspended. These holding elements are made in the form of graspers interacting in pairs which are capable of swivelling around their vertical axis. The graspers grasp the flat can near the upper can rim and on the narrow side.

Although this device makes it possible to use a slightly higher translation speed than do the solutions according to the state of the art, it nevertheless does not prevent interference with the sliver loop near the front during the depositing process.

OBJECTS AND SUMMARY OF THE INVENTION

It is a principal object of the invention to improve the fiber sliver depositing process and the build-up of the sliver column during the jigging of a flat can so that the delivery and jigging speeds may be increased. Additional objects and advantages of the invention will be set forth in the following description, or may be obvious from the description, or may be learned through practice of the invention.

The flat can is moved in the direction of the forward sides along a jigging path and is moved back along same. This process is repeated periodically during the filling of the can. According to the invention the flat can is subjected to different dynamic moments near the reversal points in its movement along the jigging path. The jigging path is the path between two reversal points. Starting at the reversal point, this jigging path is deliberately subdivided into an acceleration path which merges into a path characterized by an essentially uniform movement. A braking path follows. The opposite reversal point has been reached. An acceleration path follows the reversal of the jigging path. This is followed by a path on which an essentially uniform movement is maintained. The end is a braking path. Braking and acceleration paths are characteristic for each reversal point. Braking and acceleration paths are therefore designated as reversal paths.

It is a characteristic of the invention that the essentially uniform jigging speed is modified constantly according to the invention in proximity of the reversal points, i.e. in the area of the reversal paths. Known processes do not exert any influence there.

It is a further characteristic that the jigging speed of the flat can is decreased with such constancy near the reversal point that the speed of the flat can approaching the reversal point is reduced to value zero according to a decreasing sine-shaped or cosine-shaped progression at the reversal point and that it is increased to the original jigging speed according to a sine-shaped or cosine-shaped progression after passing the reversal point.

This process can be carried out so that the switching moment to start the sine-shaped or cosine-shaped modification of the jigging speed and its termination are determined as a function of the delivery speed of the fiber sliver. This manner of proceeding makes it possible to avoid abrupt braking and acceleration. It is thus possible to ensure trouble-free fiber sliver depositing and to improve the build-up of the sliver column at flat-can jigging speeds that are considerably higher than were normally used in the past.

It is a further characteristic of the invention that constant modification of the flat-can speed occurs within a defined path range extending from the reversal point in longitudinal direction of can movement to approximately a depositing radius of a sliver loop. A circular sliver loop which touches both lateral sides in deposited position or is at least deposited in immediate proximity thereof is meant here.

It is a characteristic of the device that the jigging device is provided with a driving device with computer-assisted controls making it possible to change the translation movement, substantially constant until then, near the jigging reversal point.

The driving device may be a servomotor controlled by a computer used as the controlling device. The servomotor implements the sine-shaped or cosine-shaped modification of the jigging speed.

It is however also possible for the driving device to be a different, less expensive electrical motor mounted on the drive shaft on which belt pulleys which can be coupled are provided.

It is characteristic here that the carriage of the jigging device is coupled to and uncoupled from the drive shaft via the belt drive as it reaches and leaves the reversal path. The belt drive has catches which engage the holding means of the carriage and thus make it possible for the movement and direction of the carriage to be changed.

According to the invention the movement of the flat can is acquired by a sensor which is installed at the limit of the reversal path. The sensor can be shifted and immobilized along the reversal path.

It is a further characteristic that the jigging device is provided with a bearing plate having a centrally located and fixed compression spring, designed so that the two ends of the compression spring are not attached and are made in the form of impact surfaces. The compression spring is installed at the level of the fixed stops of the jigging path. As the bearing plate moves in the direction of the stop of the jigging path, one end of the compression spring impacts the stop. The compression spring absorbs the kinetic energy and transmits it during expansion. In this manner a sine-shaped or cosine-shaped evolution of movement can be achieved near the reversal path.

Although the reversal point of the can remains constant, the distance of the stop can be adjusted and reset, i.e. the course of the compression spring is influenced. At different delivery speeds this possibility is utilized so that the reversal time (the time needed to travel the reversal path) may be kept constant.

If it is necessary to keep the reversal path constant for different delivery speeds, this is achieved by using different compression springs.

It is a further characteristic of the device that the jigging device is provided with means to grasp and hold the flat can. The flat can is furthermore moved on a roller track in the jigging device. Therefore the carriage arrangements for the transportation of the flat cans which would unnecessarily have increased the moment of mass inertia are omitted.

An example of an embodiment of the invention is shown in the drawing and described in greater detail below.

DETAILED DESCRIPTION OF THE PREFERRED EMBODIMENTS

Figure 1:
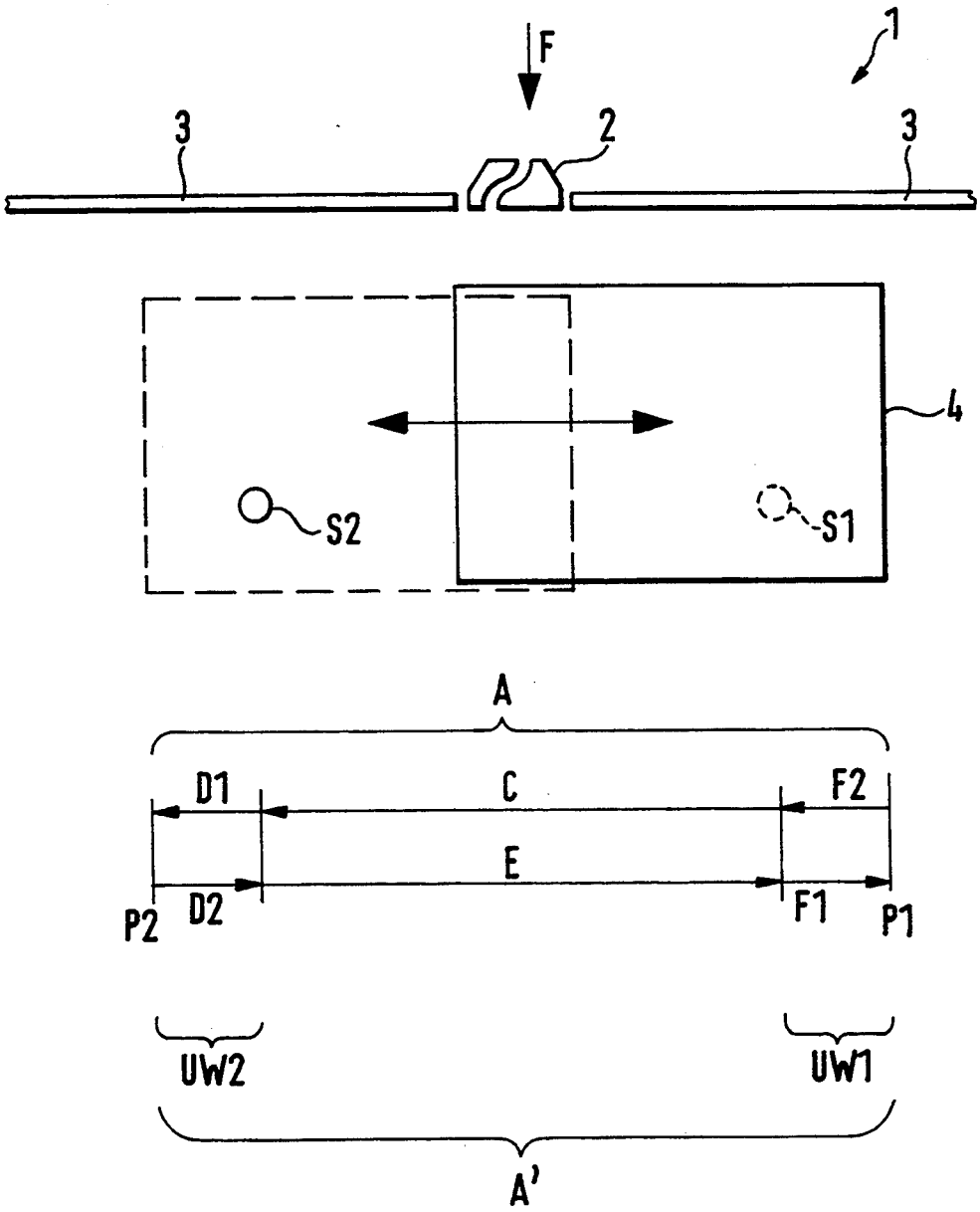
FIG. 1 shows definitions along the jigging path.
Figure 2:
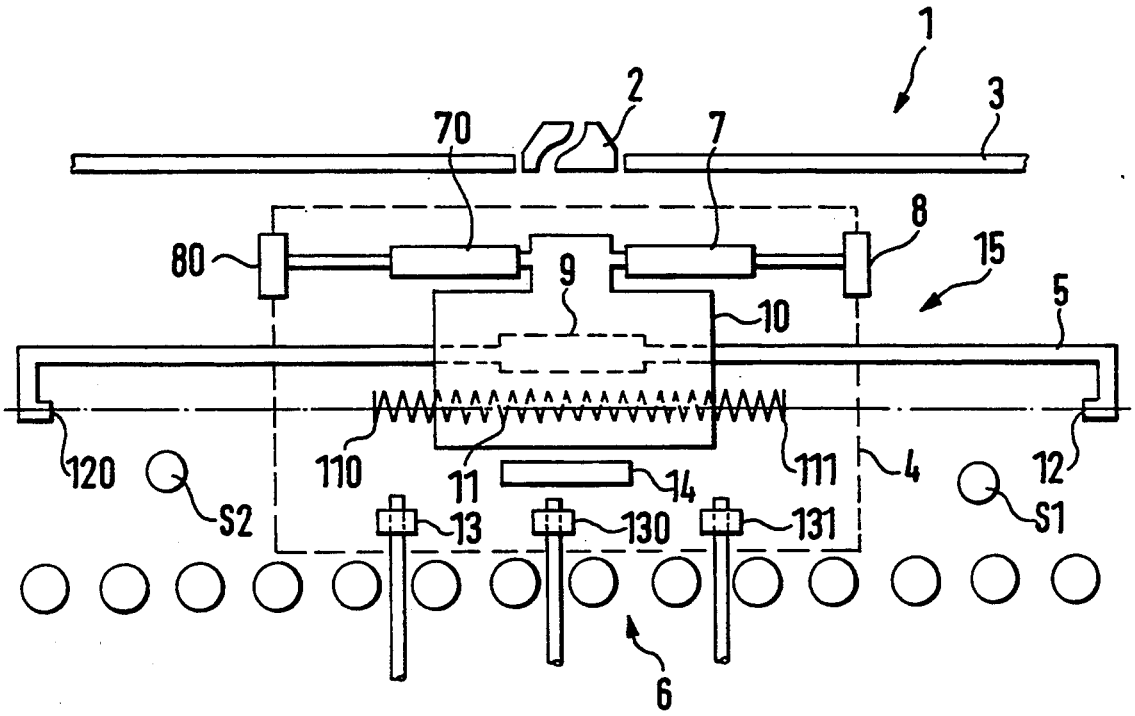
FIG. 2 shows the jigging device.
Figure 3A:
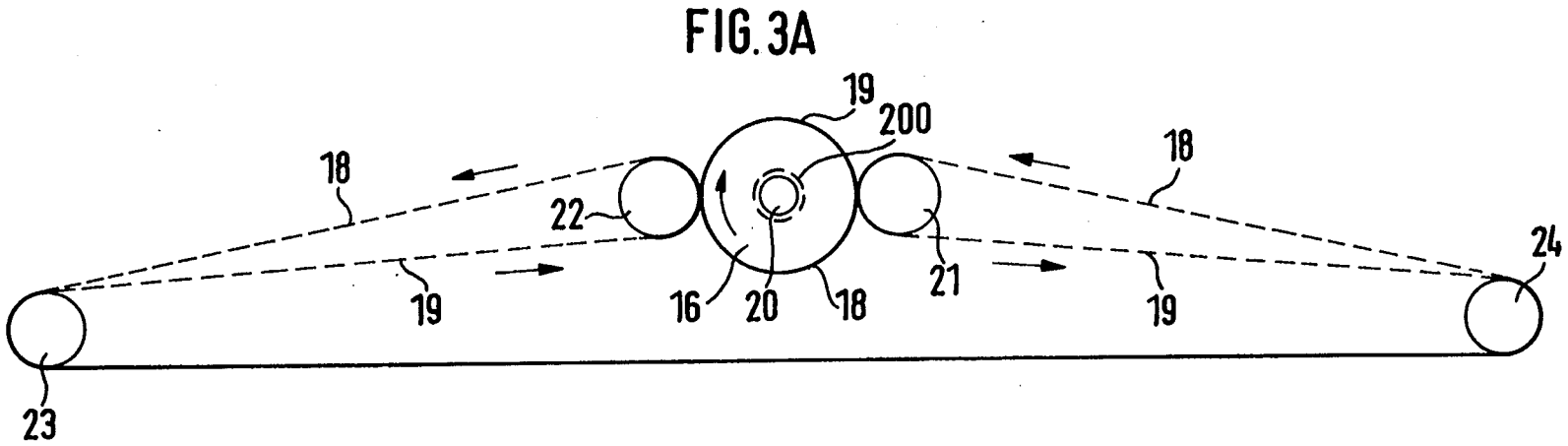
FIG. 3*a* shows a diagram of the drive with opposing belts.
Figure 3B:
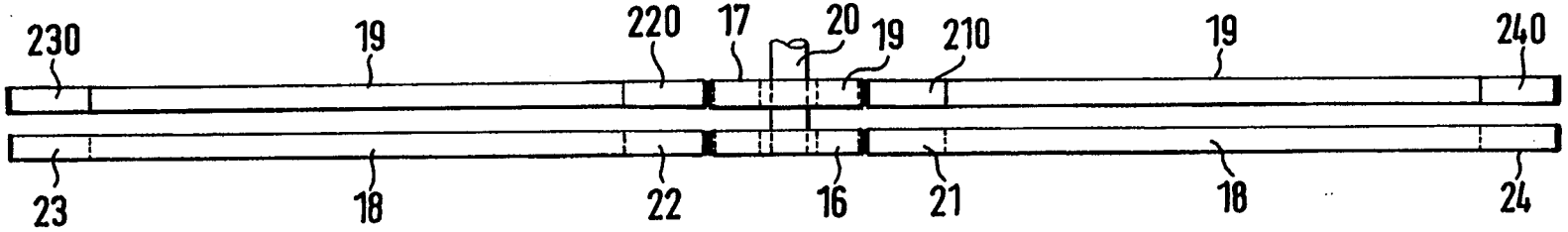
FIG. 3*b* shows a top view of FIG. 3*a;*.

Reference will now be made in detail to the presently preferred embodiments of the invention, one or more examples of which are illustrated in the drawings. Each example is provided by way of explanation of the invention, and not as a limitation of the invention. The number of components is consistent throughout the drawings and description with the same components having the same number throughout.

FIG. 1 schematically shows a filling device 1 and the appertaining flat can 4. The filling device 1 is as a rule part of a carder or a draw-frame. The filling device 1 consists in particular of a stationary rotary plate 2 surrounded by a machine table 3. The rotary plate 2 rotates and deposits the fiber sliver delivered in conveying direction F in the flat can 4 in the direction of transportation. The fiber sliver is deposited in one layer over the entire length of the can tray of the flat can. The can tray can be moved vertically and is positioned below the upper can rim when empty. As more and more fiber sliver is being deposited, the can tray descends. The fiber sliver is deposited over the entire length of the can tray. The can is moved back and forth in longitudinal direction for this purpose of sliver depositing. The flat can 4 is shown in an end position. The opposite end position of the flat can is therefore indicated by a broken line. Thanks to this can movement the rotary plate 2 is able to deposit the fiber sliver in cycloids over the entire length of the spring plate.

The flat can is moved along a path A between the two end positions and is moved back along the same path A'. Either one of these paths A or A' is the jigging path. The jigging path is the distance between the two reversal points P1 and P2.

A back-and-forth movement is carried out when the can is moved on this jigging path A and on jigging path A'. This process is repeated periodically as the can is filled.

If an outgoing travel movement in one direction is defined as going from reversal point P1 to reversal point P2 for example, then the return travel movement goes by analogy from P2 to reversal point P1.

In the course of this movement the can is subjected to different dynamic moments. The jigging path A is therefore subdivided into an acceleration segment F2 which merges into a segment C, characterized essentially by a uniform movement. The presence of a movement which would deviate to a minor degree from a uniform movement may not be excluded. However this movement has no influence on the functioning of the invention. A braking segment D1 follows. At the reversal point P2 the situation changes. An acceleration segment D2 follows. This is followed by a segment E which is characteristic for an essentially uniform movement, similarly as in segment C. The end is constituted by a braking segment F1. Braking and acceleration segments are characteristic for either reversal point. Braking and acceleration segments are therefore designated as reversal path UW1 and UW2. Any excess of the limit of reversal path UW1 or UW2 is monitored and recorded by a sensor S1 or S2.

A flat can is filled by the filling device 1 at a delivery speed which is set to be constant. This may be a delivery speed of 800 m/min, for example. In coordination with this delivery speed, a proportionate jigging speed is set. This jigging speed is reached on the segments C and E and is constant. The speed is modified in a constant and defined manner in proximity of the reversal points P1 and P2, i.e. in the areas of reversal paths UW1 and UW2.

The condition applying to a constant reversal time while jigging speeds vary is shown below:

The regular modification of the constant jigging speed is such that the movement of the flat can moving towards the reversal point is reduced in accordance with the descending progression of a sine or cosine function. The reduction continues until the value zero is reached at the reversal point. After passing the reversal point, the movement is again accelerated according to a sine-shaped or cosine-shaped progression to the maximum value, i.e. to the jigging speed. This method ensures that no abrupt braking and acceleration events occur. The regular modification begins when the reversal path is reached and ends when the reversal path is left. The point in time for the modification of the jigging speed in a sine-shaped or cosine-shaped progression is determined as a function of the delivery speed of the fiber sliver. This change of the point of time makes it possible for reversal paths of different lengths to be available for the changing of the jigging speed so as to be able to maintain the period of time required to go through the reversal path (reversal time) constant. With the assumption that it is also possible a) to keep the reversal path constant with different jigging speeds or;

b) to keep acceleration constant with different jigging speeds, a range of the reversal path was defined so that its maximum length is approximately equal to the depositing radius of a sliver loop, where the constant modification of the jigging speed takes place under the different conditions.

It was further found that even a linear decrease or increase of the speed in relation to a sine-shaped or cosine-shaped speed produces undesirable motion impacts.

The implementation of the process is described through the following device.

The jigging device 15 is located below the filling device 1. A roller track 6 on which the flat can is standing when stopped is part of the jigging device. The rollers move freely. They may be of the same width as the flat can. It is however also possible to provide two rollers next to each other, positioning them under the lower edge of the side walls of the can. The length of the roller track 6 is the same as the length of the jigging path. The roller track 6 has the advantage that it is simple in design, requires little outlay, and ensures that moving of the additional mass of a can carriage is not necessary. Guide rollers 13, 130, 131 are placed as a function of can width and hold the flat can 4 on its track as it moves in the longitudinal direction. Similar guide rollers are located on the opposite side (not visible) of the flat can. The jigging device 15 consists furthermore of a rail 5 which is delimited by impact bolts 12, 120. The length of the two impact bolts can furthermore be adjusted. The adjustability is necessary so that the jigging device may be operated at different delivery speeds. A running gear 9 is placed on this rail 5 so as to be able to travel. The running gear 9 is connected to a bearing plate 10. The bearing plate 10 is provided with a centrally located and attached compression spring 11 at its back. The ends of the compression spring 110, 111 are open and made in form of impact surfaces for the impact bolts 12 and 120. An embodiment is however also possible in which separate compression springs are connected to the bearing plate 10, so that each individual compression spring is provided with a spring end acting as an impact surface. Two centered grasping cylinders 7, 70 are provided in the upper part of the bearing plate 10. These grasping cylinders are aligned so as to be parallel to the rail 5 and each is able to swivel a grasper 8 and 80 around its vertical axis. The flat can is firmly grasped by the vertical swivelling action of the graspers 8 and 80. A horizontal movement of the grasping cylinders 7 and 70 press the graspers 8, 80 against respective stops (not shown) so that the flat can is held clampingly by the graspers 8, 80.

Jigging can start as soon as the flat can is held. The running gear 9 moves the bearing plate 10 which conveys the can along the roller track 6 by means of grasping cylinders and graspers. The roller track 6 makes it possible to dispense with the utilization of a conveyor carriage for the flat can as in the past. The flat can 4 is moved by jigging device 15 on the roller track 6. The bearing plate 10 impacts the impact bolts 120 or 12 alternately with the open end of the compression spring 110 or 111. The impact bolts 12, 120 represent the limits of the jigging path.

The flat can 4 is moved at a uniform jigging speed. In this jigging movement the flat can reaches one of the two reversal paths, e.g. UW2. Sensor S2 recognizes when the limit of the reversal path UW2 is reached. Sensor S2 registers the arrival of the incoming forward side. The distance between the two sensors S1 and S2 and the jigging reversal point can be adjusted and set (the reversal points P1, P2 correspond to the impact bolts 12 or 120). The jigging reversal path (UW1, UW2) can thus be adjusted to the desired operating conditions.

When sensor S2 signals the entry of the flat can into the reversal path UW2, this sensor S2 generates a signal which uncouples the running gear 9 with the flat can 4 from the driving device 14. Due to mass inertia, the flat can 4 moves toward the impact bolt 120. The corresponding end of the compression spring 110 meets the impact bolt 120. The compression spring 110 absorbs the mass acceleration. The compression spring 110 possesses a selected spring constant and is compressed at the corresponding end. This causes a sine-shaped or cosine-shaped speed reduction before the reversal point is reached. This speed reduction corresponds to a movement such as occurs from a maximum value of a half wave to point zero in going through a sine or cosine function.

When the reversal point has been passed, the flat can is accelerated. The compression spring expands and accelerates the flat can. The progression of this movement is calculated so as to emulate the course of a sine function or cosine function from value zero until the maximum value of a half wave is reached. As the maximum value is reached, the can has again reached its original jigging speed and leaves the reversal zone. As it leaves the reversal zone the running gear 9, and with it the flat can 4, is again coupled to the driving device 14. The driving device 14 ensures uniform movement of the flat can 4. When the opposite reversal path UW1 is reached, a regular modification of can movement takes place in similar fashion.

If the driving device is not a servomotor but another, less expensive electric motor, the movement of the can 4 is produced by two belts placed in a horizontal plane. For this purpose (FIGS. *3a*, *3b*) the driving device 14 is provided with two belt pulleys 16 and 17, on its shaft 20. These can be coupled to the shaft 20. The coupling mechanism 200 is indicated. Coupling and uncoupling is controlled by means of a known control device not shown here. The control device may be a computer. Coupling takes place so that the two belts 18, 19 are driven alternately. As shown in FIG. *3a*, the guidance of belt 18 goes from the belt edge over deflection pulleys 21, 22 and deflection pulleys 23, 24. The belt 19 is crossed in relation to belt 18 and is taken around belt pulley 17 (FIGS. *3a*, *3b*) and also over deflection pulley 210, deflection pulleys 240, 230 and deflection pulley 20. Both belts are held by a common catch (not shown) which is in turn connected to the running gear 9 or to the bearing plate 10. Since the two belts are connected by a common catch, one belt is driven in alternating operation while the other belt necessarily moves along without drive. A belt is always driven over a selected distance, equal to a distance C or E according to FIG. 1, between the deflection pulleys 23, 240 to 24, 240. When reaching the reversal path UW1 or UW2, the two belt pulleys are uncoupled from shaft 20. The can continues to travel due to mass inertia. The spring mechanism (spring 11) causes the can to reach the end of the reversal path after the reversal point. Only now is the other belt pulley coupled to the shaft 20, and an opposite longitudinal movement occurs in similar fashion.

The drive 14 with its shaft 20 maintains one direction of rotation while the belt pulleys 16, 17 are coupled and uncoupled alternately at the described moments.

Figure 4:
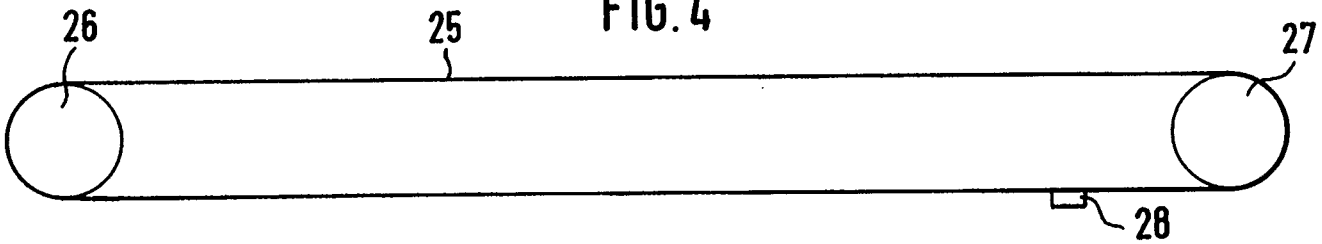
FIG. 4 shows a diagram of the drive with one belt.

It is however also possible to design an embodiment according to FIG. 4, in which only one belt 25 runs endlessly around two deflection pulleys. Belt 25 is provided with a catch 28 which alternately engages a holding device (stop) on the running gear 9 or a bearing plate 10 and thus realizes the transportation. The catch 28 leaves the corresponding holding device at the beginning of the change of direction of movement of said catch. In driving the belt, the geometry of the pulleys 27, 28 influences the regular modification of the jigging speed in the reversal paths.

It will be apparent to those skilled in the art that various modifications and variations can be made in the present invention without departing from the scope or spirit of the invention. For example, features illustrated as part of one embodiment can be used on another embodiment to yield a still further embodiment. It is intended that the present invention cover such modifications and variations as come within the scope of the appended claims and their equivalents.

We claim:

1. A device for imparting a back-and-forth jigging motion to a flat can which is to be filled with a textile fiber sliver from a rotary plate which is stationary relative to said flat can, said device comprising:

a jigging device, said jigging device further comprising a mechanism for holding a flat can relative said jigging device;

a driving device operably configured with said jigging device so as to convey said jigging device and flat can in a back-and-forth jigging motion between two reversal points, said driving device further comprising a mechanism configured to impart a modified speed to said jigging device within a predetermined reversal area adjacent each said reversal point; and said driving device further comprising a servomotor operably engaging with a running gear configured with said jigging device, said servomotor having a reversible direction of rotation for driving said jigging device in said back-and-forth jigging motion.

2. The device as in claim 1, further comprising a computer operably configured to control rotation of said servo motor.

3. A device for imparting a back-and-forth jigging motion to a flat can which is to be filled with a textile fiber sliver from a rotary plate which is stationary relative to said flat can, said device comprising:

a jigging device, said jigging device further comprising a mechanism for holding a flat can relative said jigging device;

a driving device operably configured with said jigging device so as to convey said jigging device and flat can in a back-and-forth jigging motion between two reversal points, said driving device further comprising a mechanism configured to impart a modified speed to said jigging device within a predetermined reversal area adjacent each said reversal point; and said driving device further comprising two belts alternately driven in opposite directions by belt pulleys which are alternately coupled to a common drive shaft, said belts being engageable with said jigging device.

4. The device as in claim 3, wherein said belts further comprise a common catch for engaging with said jigging device.

5. The device as in claim 3, wherein said drive shaft further comprises controllable couplings configured to alternately couple said belt pulleys to said drive shaft.

6. The device as in claim 5, wherein said jigging device comprises a running gear which is engaged with said common catch, said coupling which is coupled to said drive shaft being uncoupled from said drive shaft upon said jigging device travelling into either said reversal area towards one of said reversal points, and said other coupling being coupled to said drive shaft upon said jigging device travelling away from said reversal point and leaving said reversal area.

7. The device as in claim 6, wherein the uncoupling and coupling of said controllable couplings is controlled as a function of delivery speed of a fiber sliver into said flat can.

8. A device for imparting a back-and-forth jigging motion to a flat can which is to be filled with a textile fiber sliver from a rotary plate which is stationary relative to said flat can, said device comprising:

a jigging device, said jigging device further comprising a mechanism for holding a flat can relative said jigging device;

a driving device operably configured with said jigging device so as to convey said jigging device and flat can in a back-and-forth jigging motion between two reversal points, said driving device further comprising a mechanism configured to impart a modified speed to said jigging device within a predetermined reversal area adjacent each said reversal point; and said driving device further comprising an endless belt driven around two deflection pulleys, said belt comprising a catch which runs over said deflection pulleys thus being driven in alternate directions between said deflection pulleys, said catch being releasably engaged with said jigging device between said reversal areas.

9. The device as in claim 8, wherein said jigging device comprises a holding device for releasably engaging with said catch in either direction of travel of said catch.

10. A device for imparting a back-and-forth jigging motion to a flat can which is to be filled with a textile fiber sliver from a rotary plate which is stationary relative to said flat can, said device comprising:

a jigging device, said jigging device further comprising a mechanism for holding a flat can relative said jigging device;

a driving device operably configured with said jigging device so as to convey said jigging device and flat can at a constant speed in a back-and-forth path defined between two reversal points, said driving device further comprising a mechanism configured to drive and decelerate said jigging device within a predetermined reversal area adjacent each said reversal point and to subsequently accelerate said jigging device to said constant speed within said reversal area; and sensors disposed at each said reversal area and configured to detect travel of said jigging device into and out of said respective reversal areas said sensors in operative communication with said driving device to trigger the deceleration and acceleration of said jigging device.

11. The device as in claim 10, wherein said sensors are adjustable along said path of said jigging device.

12. The device as in claim 10, wherein said sensors are optical-electronic sensors.

13. The device as in claim 10, wherein said sensors are mechanical sensors.

14. The device as in claim 10, further comprising a roller track on which said flat can is moved in its back and forth jigging motion.

15. The device as in claim 14, wherein said roller track comprises guide rollers having vertical rotational axes, said guide rollers contacting the sides of said flat cans.

16. A device for imparting a back-and-forth jigging motion to a flat can which is to be filled with a textile fiber sliver from a rotary plate which is stationary relative to said flat can, said device comprising:

a jigging device, said jigging device further comprising a mechanism for holding a flat can relative said jigging device;

a driving device operably configured with said jigging device so as to convey said jigging device and flat can in a back-and-forth path defined between two reversal points, said driving device further comprising a mechanism configured to impart a modified speed to said jigging device within a predetermined reversal area adjacent each said reversal point; and wherein said jigging device comprises a bearing plate and a compression spring connected to said bearing plate, said compression spring having opposite ends configured as impact ends.

17. The device as in claim 16, further comprising a fixed stop disposed at each said reversal point, said compression spring disposed at the level of said fixed stops so that said impact ends impact a respective said fixed stop as said jigging device approaches said reversal points thereby modifying the speed of said jigging device in said respective reversal areas.

18. A device for imparting a back-and-forth jigging motion to a flat can which is to be filled with a textile fiber sliver from a rotary plate which is stationary relative to said flat can, said device comprising:

a jigging device, said jigging device further comprising a mechanism for grasping said flat can;

a driving device operably configured with said jigging device so as to convey said jigging device and flat can in a back-and-forth jigging motion between two reversal points, said driving device further comprising a mechanism configured to impart a modified speed to said jigging device within a predetermined reversal area adjacent each said reversal point; and wherein said mechanism for grasping said flat can comprising grasping cylinders having vertical swivelling graspers configured to grasp and hold said flat can in an area between its center and upper can rim.

19. A process for jigging a flat can, wherein a textile fiber sliver is deposited at a delivery speed in loops from a stationary rotary plate into the flat can, said process comprising:

jigging the flat can at a relatively constant speed as a function of fiber sliver delivery speed in back and forth reversal paths of a traversing path between reversal points below the rotary plate so that loops of fiber sliver are laid into the flat can;

at each reversal point and in the direction of travel of the flat can, decelerating the flat can from its constant jigging speed within a defined reversal areal before the reversal point to a zero speed at the reversal point, and accelerating the flat can from the zero speed at the reversal point up to the constant jigging speed in a defined reversal area after the reversal point, the reversal areas before and after the reversal point constituting a reversal path; and varying the length of the reversal path as a function of different fiber sliver delivery speeds thus maintaining the reversal time of the flat can in the reversal path relatively constant regardless of jigging speeds, the reversal time for the flat can in the reversal area thereby being changeable independent of the jigging speed of the flat can.

20. The process as in claim 19, comprising varying the length of the reversal path within a range extending from the reversal point to a distance equal to a depositing radius of a fiber sliver loop to be deposited in the flat can.

21. The process as in claim 19, comprising decelerating and accelerating the flat can in the reversal path in accordance with a decreasing sine or cosine shaped speed curve.

22. The process as in claim 21, comprising establishing a switching point for start of the deceleration and acceleration of the fiat can from its constant jigging speed, and changing the location of the switching point as a function of fiber silver delivery speed.

* * * * *